United States Patent [19]

Sandvik

[11] Patent Number: 4,801,091

[45] Date of Patent: Jan. 31, 1989

[54] PULSATING HOT AND COLD SHOWER HEAD

[76] Inventor: Arne P. Sandvik, 2275 Ramsgate Ter., Colorado Springs, Colo. 80919

[21] Appl. No.: 176,164

[22] Filed: Mar. 31, 1988

[51] Int. Cl.[4] ..... B05B 3/04; B05B 1/08

[52] U.S. Cl. ..... 239/381; 239/391; 239/436; 4/542

[58] Field of Search ..... 239/380, 381, 390, 391, 239/443, 444, 446, 447, 99; 4/492, 542, 615

[56] References Cited

U.S. PATENT DOCUMENTS

| | | | |
|---|---|---|---|
| 2,949,240 | 8/1960 | Koolnis | 239/444 |
| 3,568,716 | 3/1971 | Heitzman | 239/381 |
| 3,734,410 | 5/1973 | Bruno | 239/568 |
| 3,801,018 | 4/1974 | Plotz | 239/316 |
| 3,801,019 | 4/1974 | Trenary et al. | 239/444 |
| 4,010,899 | 3/1977 | Heitzman | 239/381 |
| 4,131,233 | 12/1978 | Koenig | 239/381 |
| 4,141,502 | 2/1979 | Grohe | 239/381 |
| 4,254,914 | 3/1981 | Shames et al. | 239/447 |
| 4,398,668 | 8/1983 | Jette | 4/604 |
| 4,412,834 | 11/1983 | Kulin et al. | 604/29 |
| 4,478,367 | 10/1984 | Petursson | 239/381 |
| 4,629,125 | 12/1986 | Liu | 239/443 |

*Primary Examiner*—Andres Kashnikow
*Assistant Examiner*—Karen B. Merritt
*Attorney, Agent, or Firm*—James E. Pittenger

[57] ABSTRACT

The shower head dispensing device simultaneously dispenses a plurality of separate liquids in pulsating simultaneous streams. The liquid streams are maintained separate within the device by the use of separate distribution chambers, channels and nozzle sections. A free-turning, tiered rotor is provided within the device. The rotor turns on frictionless bearings provided by hydraulic balancing of the liquid pressures around the rotor. The liquid flow is maintained separate within the device and rotor and provides pulsating liquid flow through the tiers of the rotor and out through outlet openings provided in the device. Angularly adjustable nozzles are proivided within the nozzle sections and adjacent to each tier of the rotor so that the pressurized liquids flowing through the nozzles will impinge upon the outer perimeter of the rotor causing the rotor to rotate as the desired speeds. The speed of the rotor determines the time differential between the pulses present in each of the simultaneously dispensed liquids.

23 Claims, 3 Drawing Sheets

PULSATING HOT AND COLD SHOWER HEAD

FIELD OF THE INVENTION

This invention is directed to a plural liquid, pulsating dispenser. It is more specifically directed to a shower head which provides alternating pulses of hot and cold water.

BACKGROUND OF THE INVENTION

The most common shower head is the mechanical type which has a lever which changes the pattern of water issuing from the shower head from a very fine spray to a very course stream. This shower head provides this variation to accommodate most users but fails to provide a variety of other streams and effects which are now commonly desired.

An improvement over the adjustable stream shower head is the oscillating or pulsating type shower head which has come into recent prominence. In this shower head a normal stream pattern is provided by the shower head and by rotating a control ring or lever on the outside of the shower head the stream can be changed to an oscillating or pulsating stream with varying pulsating rates or frequencies. This type of shower head provides a "massage" sensation to the bather's skin. Although this shower head has a soothing and so-called therapeutic effect, it fails to provide the ultimate sensation to the bather's skin.

In the past it has been quite relaxing and inspiring to be able to switch temperatures while bathing. This is to say that it is refreshing and invigorating for the skin to be subjected to rapidly changing water temperatures in the shower. Thus, the changing of the water temperature from hot to cold provides an invigorating sensation which is believed to provide therapeutic benefits to the skin and to the body. Nowhere is this more exemplified than in the Scandanavian countries where bathers subject themselves to relatively hot dry air temperatures in a sauna and then quickly roll in snow to cause a rapid temperature change if only momentarily. Alternating this process provides a relaxing and highly stimulating sensation to the bather's skin.

The present invention provides a combination of these sensations in a very practical, relatively inexpensive and novel shower head.

INFORMATION DISCLOSURE STATEMENT

This section is provided in order to comply with the applicant's acknowledged duty to reveal to the Patent Office all pertinent information which may affect the examination of this application. The following prior art patents comprise the prior art which is known to the applicant and which is considered pertinent to this application.

The patents to Heitzman (U.S. Pat. Nos. 3,568,716 and 4,010,899) show pulsating shower head devices having rotary driven turbine valves which interrupt the water flow and cause a pulsating action. These devices also include the provision of a passageway or valve to bypass the flow of water around the rotor or rotary valve. This bypass valve allows a steady stream of water to flow through the shower head or the pulsating action, whichever is desired.

The Bruno patent (U.S. Pat. No. 3,734,410) shows another pulsating spray shower head. A wobble plate with a center support causes a wobbling action which interrupts the water flow, causing the pulsating condition. The nozzle openings in this device are shown to be arranged in a circular pattern.

The patents to Shames (U.S. Pat. No. 4,254,914), Petursson (U.S. Pat. No. 4,478,367) and Koenig (U.S. Pat. No. 4,131,233) merely show additional pulsating shower heads which use rotating members for interrupting the water flow to cause the pulsations.

The Plotz patent (U.S. Pat. No. 3,801,018) shows a steady stream shower head having a rotating diffuser which causes the aeration or mixing of the shower head water flow. An injector is utilized for introducing various soaps, oils or emollients which causes the shower head to discharge an aerated stream producing bubbles or emulsions. A nozzle block upstream of the rotor has a plurality of angularly positioned nozzles directed to impinge on the rotor.

The Jette patent (U.S. Pat. No. 4,398,668) shows a shower head control structure wherein the shower head has internal valving which allows the head to be aligned with the hot and cold water supply lines or pivoted to shut off the water flow to the head. When the hot and cold water supply lines are aligned with the inlets to the shower head, the rotation of the control handle causes the mixing of the hot and cold water to the desired temperature. This patent has been cited since it shows a separate source of hot and cold water to the shower head which is uncommon with most devices.

The Kulin, et al. patent (U.S. Pat. No. 4,412,834) shows a connector valve selectively permitting a transfer of at least two fluids as desired. A plurality of conduits are connected to the valve. The valve can be rotated in various positions to allow the desired liquid to flow at any one time. This patent is considered pertinent since it discloses a rotary valve which allows liquid passage through the rotating valve member when the internal passageways are aligned with the desired conduit.

SUMMARY OF THE INVENTION

This invention is directed to a shower head for physical stimulation of the body. It attempts to produce the same effect which is obtained when a person sits in a sauna which is then followed by a cold shower and then back to the sauna again. The present invention allows these rapid changes in temperature to be accomplished in a matter of seconds or portions of a second. By being able to change the time between the hot and cold pulses provided by the shower head, the stimulus to the skin can be varied. The shorter the time differential, the less the change in temperature will be noticed by the skin, and the longer the time differential the more effect the change in temperature will have. The length of each pulse and thus the amount of water in each pulse is varied to provide the desired effect.

The invention includes a compound shower head, which conveys separate streams of hot and cold water simultaneously. These two streams of water are maintained separate throughout the shower head and the output nozzle. An internal freely rotating, tiered rotor is provided which is arranged to be supported within the housing on liquid "bearings". This so called bearing arrangement is provided by hydraulic balancing of the water pressure at the top and bottom of the rotor.

The rotor is divided so that a pair of 45° open segments run from the upper tier level to the bottom of the rotor. 90° opposite is a second pair of 45° open segments, which extend from the second tier to the bottom of the rotor. Thus, at the bottom of the rotor the tier openings are spaced at 90° intervals with respect to each other around the entire circumference. Each tier level has a set of four angularly adjustable nozzles equally spaced around the circumference of the rotor and arranged at the outer perimeter of the rotor. At the bottom of the shower head is a support plate having a series of outlet holes formed in a generally circular pattern coinciding with the location of the open rotor segments.

A very important feature of the invention is the ability to control the speed of the rotor by means of varying the angular position of the nozzles with respect to the outer perimeter of the rotor. Each tier of nozzles can have a separate set of nozzles and a separate control ring to variably position the nozzles, if desired, or all nozzles can be controlled by a single ring or other control device. The angular position of the nozzles determines the hydraulic force which impinges on the rotor segments which in turn, is used to control the speed of rotation of the rotor. The openings in the rotor and the rotor speed determines the time period or time differential between the hot and cold water pulses.

The principal of this invention can be applied to other devices in which multiple fluids are required to be applied or dispensed separately and simultaneously. For instance, two or more different colors of paint may be applied simultaneously or two or more chemicals may be dispensed when it is desirable to keep them separated until contact is made with the surface being coated or treated.

It is to be understood that this invention is not to be limited to the use of only two fluids, but it can be altered to apply any number of fluids or different temperature liquids when desired. This is accomplished by applying corresponding distribution channels within the device and separate rotor tiers and nozzles for each liquid dispensed.

Other features and advantages of the present invention will become apparent from the following detailed description of the invention when it is considered in conjunction with the accompanying drawings.

Figure 1:
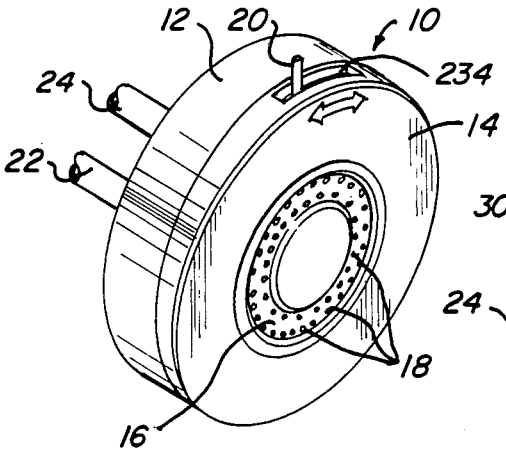
FIG. 1 shows a perspective view of the pulsating hot and cold shower head according to the present invention.
Figure 2:
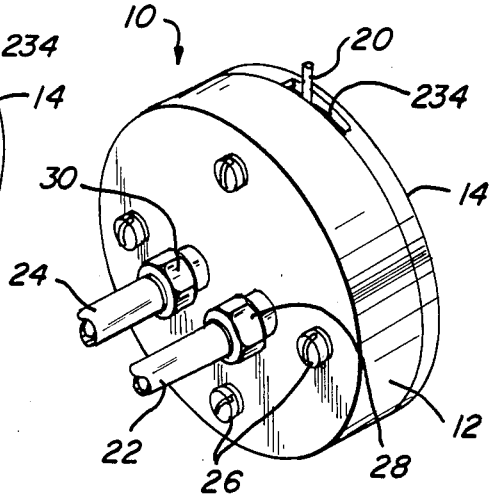
FIG. 2 is a rear perspective view.

DETAILED DESCRIPTION OF THE INVENTION:

Turning now more specifically to FIGS. 1 and 2, the shower head 10 according to the present invention includes the outer case or body 12, front cover 14 including shower outlet nozzle 16 having discharge holes 18. A pulse time control lever 20 protrudes through a slotted opening in the side of cover 14. Inlet supply pipes, conduits or tubes 22, 24 provide water at different temperatures or entirely different liquids.

Suitable fasteners, such as screws 26 seen on the back side of body 12, hold the interior components and front cover 14 in proper position. The inlet water pipes 22, 24 can be attached to the shower head 10 in any desired fashion such as by the use of gasket, compression or flared couplings 28, 30.

Figure 3:
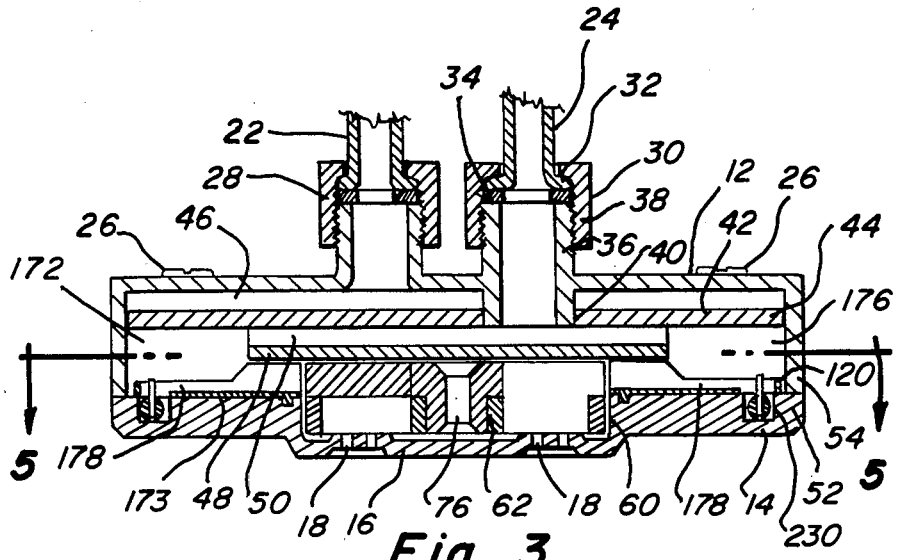
FIG. 3 is a side cross-sectional view taken along the lines 3—3 of FIG. 5.
Figure 4:
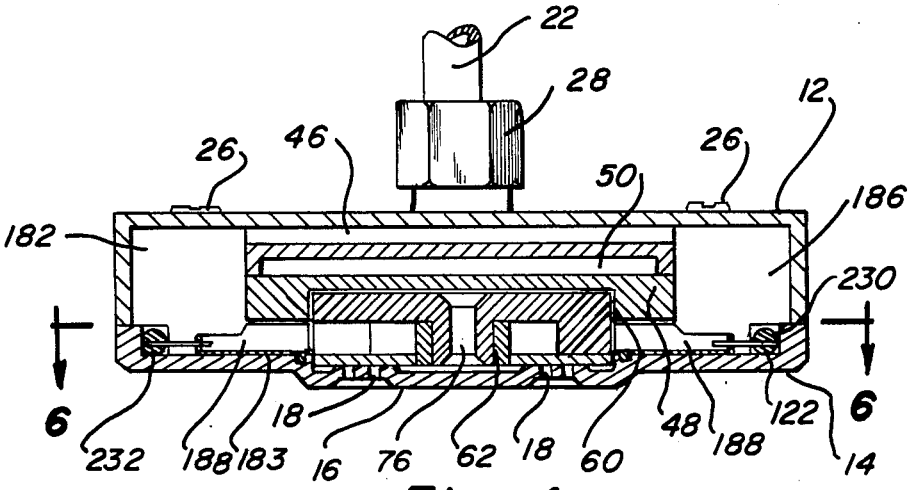
FIG. 4 is a side cross-sectional view taken along the lines 4—4 of FIG. 6.
Figure 5:
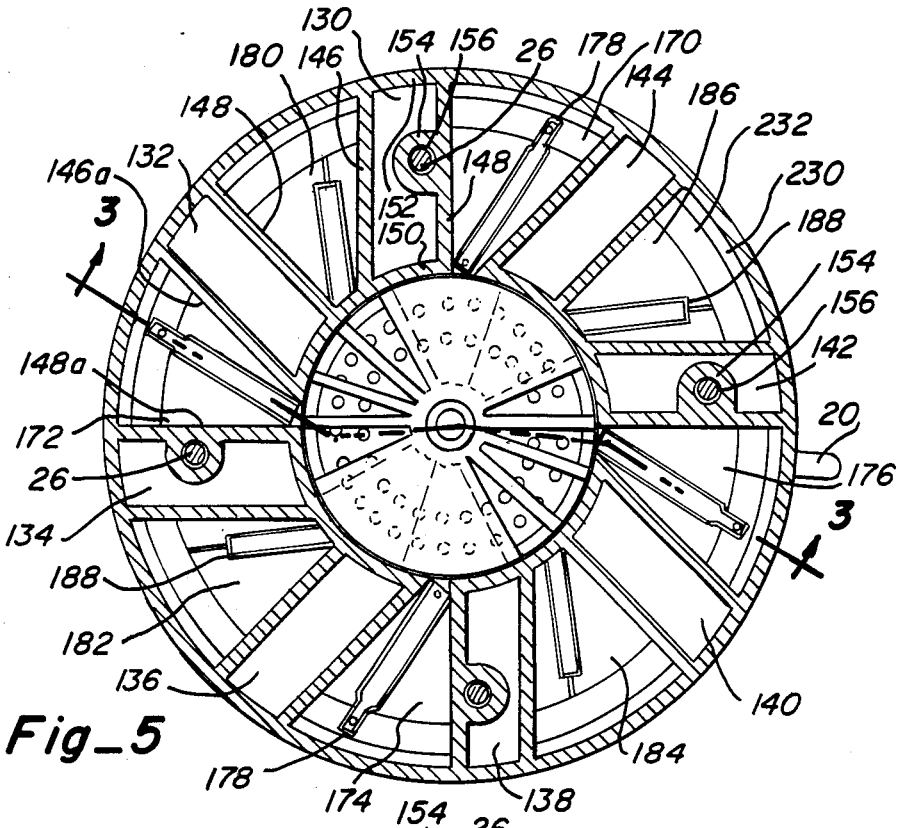
FIG. 5 is a top cross-sectional view taken along lines 5—5 of FIG. 3.

To understand the internal construction of the present invention it is necessary to consider both FIGS. 3 and 5 together. For the sake of illustration, the inlet liquid pipe or tube 22 will be assumed to be carrying cold water and on the other hand, pipe or tube 24 will be simultaneously carrying hot water. In order to understand the explanation that will follow, separate references will be made to the cold water portion and the hot water portion of the device. For illustrative purposes the explanation for the hot water portion is typically shown in FIGS. 3 and 5 while the cold water portion is substantially shown and will be described with reference to FIGS. 4 and 6.

Tube 24 is illustrated to have a flared end 32 which fits against sealing washer or gasket 34 and the end of nipple 36. The upper end of the nipple 36 is threaded which, in turn, mates with compression cap 38 which retains the tube 24 in a water tight sealed connection. The inner end of the nipple 36 extends through the body 12 and through bore 40 provided in plate 42. The inner end of the nipple 36 is sealed to the plate 42 to prevent leakage.

The flat circular plate 42 extends across the entire inner cavity of body 12 and provides a seal around the outer edge 44 with the inner surface of the body 12. In this way, a cold water distribution chamber or cavity 46 is provided between the upper surface of the plate 42 and the lower surface of the back of the body 12. Another generally circular plate 48 is centrally located within the center portion of the device and is spaced downwardly from the upper plate 42 to provide a hot water distribution chamber or cavity 50. The inner portion of the nipple 36 is open directly to the cavity 50.

Front cover 14 which has the same diameter as the body 12 is held in contact at its outer edge 52 with the outer edge 54 of the body 12. A suitable sealing mechanism (not shown) can be provided to seal this joint and prevent external leakage from the device.

The front cover 14 extends across the entire front surface of the shower head 10 and provides a slightly protruding nozzle area 16 which has a generally concentric pattern of outlet holes 18. As can be seen in FIGS. 3 and 4 the inner side of the nozzle area 16 coinciding with the outlet holes 18 is raised slightly for purposes that will be explained later.

Figure 7A:
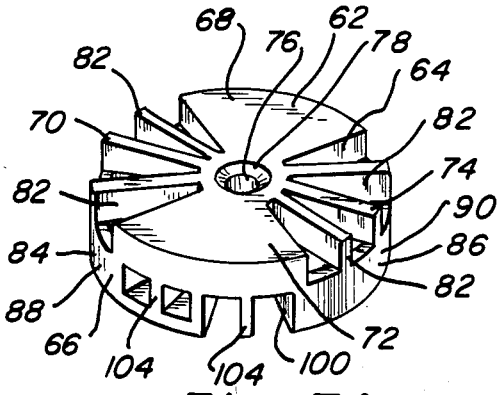
FIG. 7A is a top perspective view of the rotor.
Figure 7B:
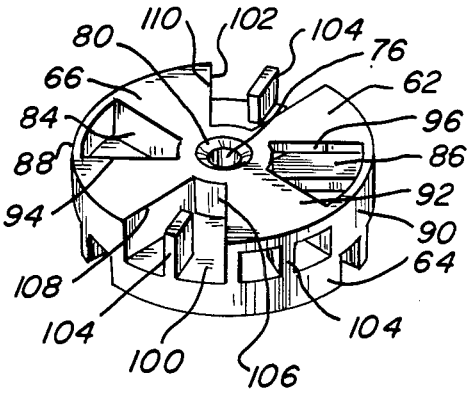
FIG. 7B is a bottom perspective view of the rotor.
Figure 9:
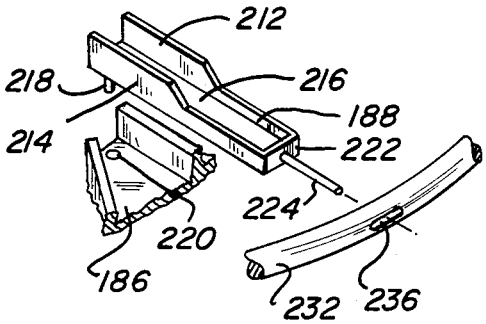
FIG. 9 is a partial assembly view of a lower adjustable nozzle.

A circular recessor chamber 60 is provided within the back side of the cover 14 and between the lower surface of the distribution plate 48. A cylindrical rotor 62 is provided which is sized to fit within the chamber 60. As seen in FIGS. 7A and 7B, the rotor 62 is essentially divided into an upper tier 64 and lower tier 66. The upper tier 64 is divided into generally equal segments 68, 70, 72 and 74. Each of these segments as provided in the present illustration has an angle of approximately 90°. A central bore 76 which is arranged concentrically with the center axis of the rotor 62 is included. The outer edges 78 and 80 of the bore 76 are chamfered to prevent restriction of liquid flow through the passageway 76.

The upper tier segments 70 and 74 provide radially extending blades or paddles 82. These blades are normally equally spaced across the open segments and are normally solid in cross section. Coinciding and contiguous with the open segments 70, 74 in the upper tier are open segments 84, 86 in the lower tier. The outer perimeter of segments 84, 86 are encased in circular wall sections 88, 90, respectively which enclose the open segments 84, 86 and provide support for the blades 82 which are attached thereto.

A bottom flat surface 92 is provided on the bottom side of the rotor 62 and includes segmental cutouts or openings 94 and 96. These cutouts or openings 94, 96 correspond with the open segments in the lower portions 84, 86 and top portions 70, 74 of the rotor. The openings 94, 96 can be of any size such as one-half of the angular opening of the corresponding open segments which in this case makes them approximately 45°.

In a similar fashion, the lower tier 66 of the rotor 62 includes open segments 100, 102. These segments are also approximately 90° and include upright blades or paddles 104. The blades 104 are different than the blades 82 in that they extend inwardly only about one-half of the radius of the rotor. Thus, the area between the inner core 106 and the end of the blades 104 is left open. Additional openings 108, 110 which are part of open segments 100, 102, respectively, and which are arranged diametrically opposite to each other are provided in the surface 92 and alternate with the openings 94, 96. The openings 108, 110 can also be approximately one-half of the area of the open segments 100, 102. Thus, while open segments 100, 102 are approximately 90°, the openings 108, 110 provided in the surface 92 are approximately one-half of this or 45°. It is important to note that the openings 108, 110 alternate with the openings 94, 96 and are equally spaced around the perimeter of the rotor bottom surface 92.

As can be easily seen, the rotor 62 is arranged so that liquid, such as water, entering the open edges of the segments 70, 74 provided in the upper tier 64 can pass inwardly through these segments and then downwardly through the rotor 62 to exit through the openings 94, 96 in the bottom surface 92. At the same time, liquid entering through the perimeter of the open segments 100, 102 provided in the lower tier 66 can flow separately and downwardly through the open areas 108, 110 provided in the bottom surface 92. Thus, the different liquids flow inwardly through the perimeter of the rotor 62, make a 90° bend and flow outwardly through the bottom surface of the rotor.

The rotor 62 as described above is mounted within the recess or cavity 60 provided within the shower head 10. The rotor is sized to closely fit within the cavity 60, and yet is free to rotate in a free-wheeling manner within this cavity. A small amount of the liquid as it flows through the shower head and through the rotor 62 leaks around the rotor to fill the cavity 60. The leakage can flow easily through the rotor center bore 76 and support the rotor with substantially equal pressure on the top and bottom thus, balancing the forces on the outer surfaces of the rotor. In addition, the liquid provides a lubricating effect which allows the rotor to rotate freely within the cavity.

The internal structures within the outer body 12 and cover 14 include additional chambers which form levels 120, 122 within the shower head 10 (see FIGS. 3 and 4). The upper level 120 corresponds with the tier 64 provided in the rotor 62. While at the same time, the lower level 122 corresponds with the lower tier 66 provided in the rotor. These levels coincide with the positioning of the perimeter openings in the various segments of the rotor. These levels communicate independently and directly with their corresponding distribution chambers 46 or 50.

Figure 6:
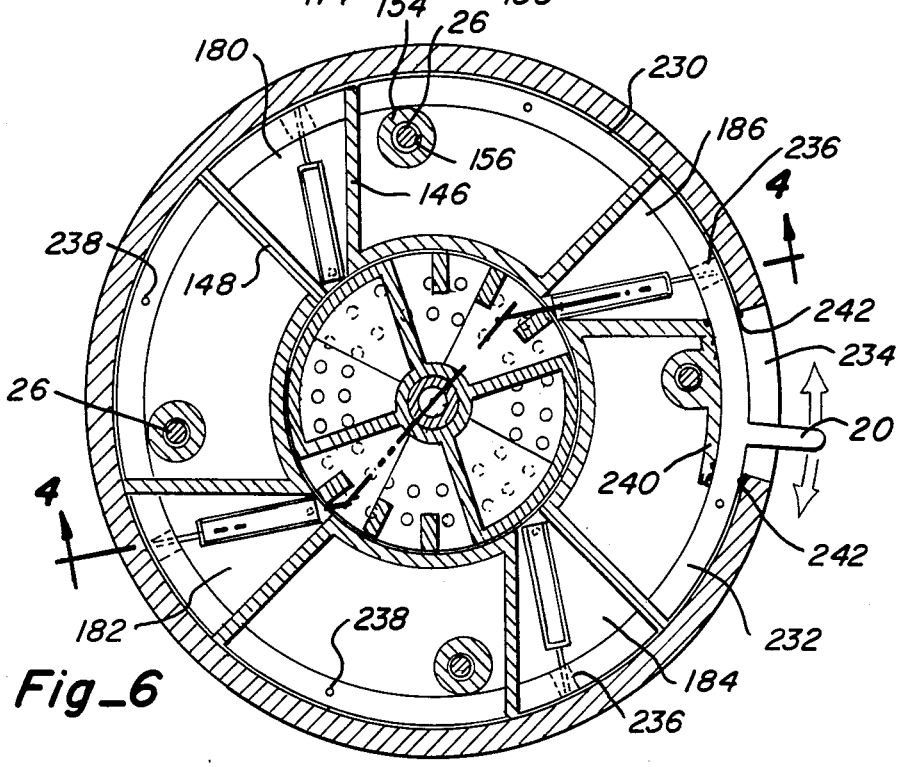
FIG. 6 is a top cross-sectional view taken along lines 6—6 of FIG. 4.

Looking internally at the shower head as viewed in FIGS. 5 and 6, small enclosed sections 130, 132, 134, 136, 138, 140, 142 and 144 are positioned around and extending longitudinally through the shower head approximately the length of the body 12. These sections also extend transversely across the shower head from the outer perimeter of the body to the circular interior surface which defines the outer perimeter of the recess or cavity 60. These sections can be formed either as solid portions or can be hollow and formed by partitions or walls 146, 148, 150, 152. These walls are essentially identical and have the same relative shape and size in all of the sections 130–144. Where the closed sections are hollow, a tubular section 154 having a bore 156 extends longitudinally through a plurality of the sections to allow the screws 26 to pass through the body of the shower head without leakage so as to threadedly attach the front cover 14 to the body 12. As provided in this illustration, four screws are provided to retain the front cover and the internal components in proper position.

It should also be noted that the position of partitions or walls 146 and 148 are quite important to the functioning of this device. The wall 148 is positioned on a radial extending outwardly from the axis of rotation of the rotor 62 so that the wall is approximately 90° or perpendicular to the outer edge of the rotor recess or cavity 60. At the same time, the wall 146 is canted at an acute angle with respect to the wall 148 of the adjacent section 132. This angle is approximately 60° and thus, the areas between the enclosed sections 130–144 form quasi 60 ° right triangles or pie-shaped sections which are used for liquid distribution and locating rotor nozzles.

As stated previously, it will be assumed that the tube 22 which is attached to the connector 28 on the back of the shower head 10 will carry cold water. While at the same time, it will be assumed that the tube 24 attached to the connector 30 will carry hot water having a considerably higher temperature than the temperature of the water in tube 22. Thus, pressurized water supplies having two distinct temperature characteristics are introduced simultaneously to the shower head. As seen in FIG. 3 distribution chamber 46 contains cold water while distribution chamber 50 contains hot water. Triangular sections 170, 172, 174 and 176 formed between the enclosed sections include a channel shaped nozzle 178 which rests on the bottom surface 173 of the upper level 120 which is formed on the inside surface of the cover 14. This triangular section partially formed by side walls 146 and 148 extends from the bottom surface 173 of the upper level 120 to the upper surface of the hot water distribution chamber 50 formed by plate 42. The sections 170–176 provide an open chamber or passageway which directly connects the hot water in the distribution chamber 50 with the nozzles 178 provided in the respective sections. Thus, the nozzles 178 are simultaneously subjected to hot water flow from distribution chamber 50.

The alternating triangular sections 180, 182, 184 and 186 also each include a channel-shaped nozzle 188 at the bottom surface 183 of the nozzle section which corresponds to the lower level 122. The cold water nozzles 188 in this way lie on the inside surface of the front cover 14 and adjacent to the lower tier 66 provided in the rotor. The hot water nozzles 178 and the cold water nozzles 188 are held in position in their respective locations between the lower surface of the circular wall 48 which defines the hot water distribution chamber 50 and the front cover 14. The diameter of the wall 48 has a greater dimension than the rotor 62. This additional dimension provides an overhang or retaining area which holds the nozzles 178 and 188 in place.

Throughout the construction provided in the shower head, partitions or walls are utilized to segregate the various passageways and chambers so as to maintain separation between the various fluids introduced into the shower head. The nozzle sections which are provided can be of any number, but in most cases it is anticipated that an equal number of sections will be provided for each separate liquid system required. In addition, although it is not absolutely necessary, it is anticipated that the various nozzle sections which are arranged around the perimeter of the shower head will be arranged in alternating fashion as shown and illustrated. Thus, the hot and cold nozzle sections will alternate around the perimeter and will be essentially equally spaced.

While two independent liquid systems have been disclosed in this application, it is to be understood that any number of separate systems can be provided depending upon the number of liquids which are to be dispensed simultaneously. Thus, a greater number of systems can be provided beyond the two that are described herein. It is important, however, that the alternating arrangement of the nozzle chambers be maintained if it is desired to provide an even mixing and coating of the liquids upon dispersion and contact.

A very important feature of the present invention is the ability to control the speed of the rotor 62 and thus, the time differential between the water pulses. The speed control of the rotor 62 is accomplished by means of variably positioning the nozzles within at least one set of nozzles. Thus, to clarify, the nozzles 178 which include all of the hot water nozzles are considered to be one set while the cold water nozzles 188 are considered to be a second set. Although these nozzles can be controlled separately, the present embodiment combines these nozzles with one control mechanism so that all nozzles are simultaneously angularly positioned as desired.

Figure 8:
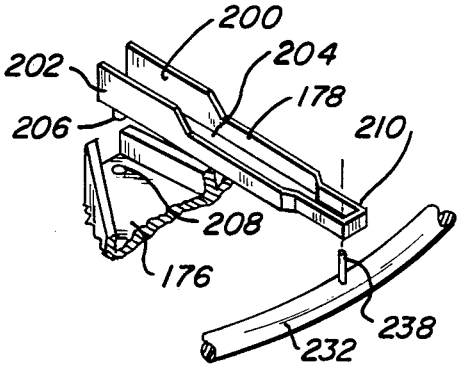
FIG. 8 is a partial assembly view showing an upper adjustable nozzle.

The hot water nozzle 178 comprises a bent sheet metal structure which includes side walls 200, 202 and bottom panel 204. The side walls 200 and 202 are bent perpendicular to the bottom panel 204 to provide a trough or channel effect. The inner end of the bottom panel 204 includes a downwardly extending pin 206 which is sized to pivotally fit a hole 208 provided at the inner edge of the section 176 or any of the other sections. The pin 206 properly positioned in hole 208 holds the inner end of the nozzle 178 in proper position and yet allows the opposite end to swing in an arc which is limited by the confines of the triangular section 176. The inner ends of the side walls 200 and 202 extend to a height which is approximately double the outer sections of the side walls. The transition between the heights of the side walls can be abrupt or tapered as shown in FIG. 8. The outer ends of the side walls 200, 202 extend beyond the end of the bottom panel 204 and form a U-shaped clip 210.

The cold water nozzles 188 are generally shorter than the hot water nozzles 178 and also include side walls 212, 214 and interconnecting bottom panel 216. Pin 218 is provided in the bottom of the inner end of bottom panel 216 and is sized to pivotally fit within the hole 220. The side walls 212, 214 also are arranged so that the inner half or portion of the side walls are approximately twice as high as the outer portions. To improve liquid flow characteristics in the nozzles the heightened portion of the side walls of both nozzles 178 and 188 essentially correspond with the overhang length of the wall 48 which defines the recess 60 for the rotor 62. The actual height of the nozzles in this area is slightly less than the height of the respective nozzle level. Thus, the water flow transitions from the nozzle channels or sections to retain the inner ends of the nozzles 178 and 188 and to provide proper nozzle flow to the rotor.

The outer end of the nozzle 188 includes a cross member 222 which interconnects the ends of the side walls 212, 214 and the bottom panel 216. A pin 224 is fixedly attached to the outer surface of the end member 222 and is arranged to extend perpendicularly outward approximately $\frac{1}{4}''$ to $\frac{3}{8}''$. Actual length can be determined depending upon the internal dimensions of the shower head.

A circumferential groove 230 is provided around the inside edge of the front cover 14 and includes a closed circular ring 232 which is arranged to slidably fit within the groove 230. A small segment of the outer edge of the front cover 14 is removed to provide a slot 234 through which a lever or handle 20 attached to the ring 232 extends. The ring 232 includes a plurality of transverse slots 236 and pins 238 which extend upwardly around the perimeter of the ring 232. These pins are equally positioned around the perimeter of the ring 232 while the slots 236 are also equally spaced and alternate with respect to the pins. The slots 236 are also equally spaced from the pins 238. The pins and slots are positioned with respect to the handle to correspond to the position of the appropriate nozzle sections. The pins 224 in the cold water nozzles 188 are positioned within the transverse slots 236 provided in the ring 232 while the U-shaped clip 210 at the end of the hot water nozzles 178 are positioned over the pins 238. The width of the clip 210 and the width of the slots 236 are generally the same to provide the same relative freedom of movement between the nozzles 178, 188 and the ring 232.

As the handle 20 and the ring 232 are moved back and forth as shown by the arrows in FIG. 6, all nozzles move simultaneous and are coordinated to move essentially the same angular distance with all nozzles being essentially angularly positioned with respect to the outer surface of the rotor 62. The inner openings of the hot water sections 170–176 and cold water sections 180–186 terminate at the edge of the rotor recess 60 and have a width and height which approximates the end opening of the hot and cold water nozzles 178, 188, respectively. Sufficient clearance is provided in these openings to allow the nozzles to pivot freely within the sections. Thus, the nozzles are essentially capable of pivoting across substantially the entire 60° arc that is found across the angular sections.

The slot 234 for the protruding control handle 20 provides an opening which is greater than 60° so that the handle and ring 232 can be moved at least a minimum of 60° to permit the nozzles to be pivoted to their maximum limits. Of course, it is to be understood that the angular position of these sections can be increased or decreased to allow greater or less freedom of movement of the nozzles as desired. A retaining partition 240 can be provided behind the open slot 234 to support and retain the ring 232. Suitable seals 242 such as O-rings or packing strips can be provided to prevent liquid leakage through the slot 234, especially when the handle 20 is repositioned.

While the described embodiment shows the cover of the shower head to be positioned at the outlet end of the device, it should be understood that the cover, if desired, could actually be placed at the inlet end. By the same token, the rotor recess could be located in the central interior of the device with the body formed from two or more sections which can be assembled in any conventional manner.

OPERATION

The shower head 10 which is provided according to the present invention is extremely simple to operate. Water is introduced into the tubes 22, 24, usually having a considerable temperature differential. The hot and cold water, as provided in the present illustration, flows into the distribution channels 46 and 50, respectively, and then flows into the respective nozzle chambers 170–176 and 180–186. The hot water is introduced through the nozzles 178 which form a discharge stream impinging upon the outer perimeter and blades of the upper tier 64 of the rotor 62. The water stream is directed against the outer perimeter of the rotor 62 at a desired angle which is determined by the angular position of the nozzle. The liquid impinging upon the blades 82 cause the rotor to spin in a counterclockwise direction as viewed in FIGS. 5. At the same time, the cold water flowing through the nozzles 188 simultaneously impinge upon the blades 104 provided in the lower tier 66 of the rotor 62. The angle of the cold water nozzles 188 is essentially the same and in the same direction as the hot water nozzles 78.

The hot water is caused to pulsate from the individual nozzles since it flows only when the open segments 70, 74 of the rotor are adjacent to the respective nozzle. As the rotor turns the closed segments 68, 72 pass in front of the respective nozzles causing the flow to be momentarily obstructed. This same effect is produced in the lower tier of the rotor adjacent to the cold water nozzles, but at a different angular position of the rotor. The water flows from the nozzles when the open segment of the rotor is aligned which permits the water to flow into the open segment and out through the corresponding smaller opening provided in the lower surface 92 of the rotor causing a pulsating flow.

The openings provided in the lower surface 92 of the rotor are positioned and aligned with the circular hole pattern provided by the outlet holes 18 located in the nozzle section 16. The bottom rotor surface 92 is positioned in close proximity to the upwardly raised nozzle section 16 containing the outlet holes 18. In this way, the openings are closely coupled to the outlet holes 18 to prevent or minimize the water leaking back into the recessed area 60 causing recirculation within the shower head. Thus, the pulsating water flow will be directed through the nozzles, downward through the rotor and out through the outlet holes 18.

In applying the teaching of this invention, it is not necessary to apply relatively close tolerances to the internal components. It is necessary, however, to have sufficient, but not excessive clearance to allow the rotor to turn freely within the recess. No rotor shaft or pivot is required, but can be provided if desired. The mating surfaces of the other components within the shower head can fit relatively close, but do not require seals between the various flow chambers. This condition occurs because the liquid pressures within the sections of the device are relatively equal. Thus, actual internal leakage across internal partitions or between components will be minimal. Even slight internal leakage can be tolerated without notice or detrimental effect to the overall desired result or sensation provided by the use of the device.

Although the outlet holes in the nozzle 16 have been described as being arranged in a generally continuous circular pattern it is also possible that these holes can be arranged in groups which have the same general radial position as the openings 94, 96 and 100, 102 provided in the bottom surface of the rotor 62. In this way, a different pulsating sequential pattern can be provided. It should also be understood that in the final design of the dispenser, the rotor can be arranged to turn in either direction.

The shower head or dispenser according to the present invention can be manufactured from any materials which are suitable for the intended liquid environment. In most cases, where the device is used as a shower head and the separated liquids have a temperature differential, various metals such as stainless steel, anodized aluminum or chrome plated brass can be used. In addition, synthetic materials such as various plastics or synthetic resins can be utilized for making some or all of the components. No special concerns are anticipated except that the materials which are selected must be capable of withstanding the temperatures or chemical characteristics of the liquids which will be dispensed by the device. Suitable seals and connections should be selected to withstand the anticipated liquids and the frequency of use which is anticipated.

While a shower head dispensing device has been shown and described in detail in this application, it is to be understood that this invention is not to be considered to be limited to the exact form disclosed and changes in the detail and construction of the device may be made without departing from the spirit thereof.

What is claimed is:

1. A liquid dispensing device for simultaneously dispensing a plurality of liquids in separate pulsed streams, the device comprising:

(a) a body means, said body means having liquid inlet and outlet means and a rotor recess arranged within said body means;

(b) said liquid inlet means including separate inlet conduit means for each liquid to be dispensed, said conduit means being arranged to include connector means whereby said conduit means can be connected to a suitable pressurized source of said liquid;

(c) distribution means arranged within said body means, said distribution means having a separate distribution chamber means and nozzle channel means for each liquid to be dispensed, each chamber means being connected to one of said inlet conduit means, each channel means having at least one nozzle means properly positioned and arranged next to said rotor recess;

(d) a rotor means arranged to freely rotate within the rotor recess formed within said body means, said rotor being divided into a plurality of tiers extending along the axis of rotation of said rotor means, at least one separate tier being provided for each liquid to be dispensed, one end of said rotor means coinciding with one end of said axis of rotation having a flat surface of rotation and each tier having one or more open angular segments which extend from the perimeter of the rotor tier to an opening in the flat surface of said rotor means, all of the surface openings on said rotor means being positioned to have at least a portion of the opening at the same radius from the axis of rotation of said rotor means; and (e) said liquid outlet means having at least one opening in the surface of the body means which connects with the rotor recess and the flat surface of said rotor means, said opening means being positioned to correspond to the position of the rotor openings in the flat surface whereby the respective liquid will be dispensed from the rotor and through the outlet means when the segment opening corresponding to the rotor tier is aligned with said outlet means.

2. A liquid dispensing device as defined in claim 1 wherein said body means includes a cover means removably secured at one end of said body means and said outlet means is positioned within said cover means.

3. A liquid dispensing device as defined in claim 1 wherein a plurality of nozzle channel means are provided and connected to each chamber means, each of said nozzle chamber means include one nozzle means and the chambers are spaced equally around the perimeter of said rotor recess.

4. A liquid dispensing device as defined in claim 3 wherein said nozzle channel means alternate with the nozzle channel means connected to other chamber means within said body means.

5. A liquid dispensing device as defined in claim 1 wherein said rotor recess is sized to closely fit said rotor means, sufficient clearance being provided between the rotor recess and said rotor means to permit liquid leakage to occur within said rotor recess whereby the liquid leakage will provide lubrication to allow the rotor to freely turn within said recess.

6. A liquid dispensing device as defined in claim 5 wherein said rotor means has a central bore which allows the liquid leakage present within said recess to pass freely between the flat surface and the opposite surface of said rotor means to balance the liquid pressures on the rotating surfaces of the rotor means.

7. A liquid dispensing device as defined in claim 1 wherein said outlet opening means is a plurality of openings which are formed on a circle of rotation having an equal radius and coaxial with the axis of rotation of said rotor means.

8. A liquid dispensing device as defined in claim 7 wherein said outlet opening means are arranged in groups which are equally spaced around the circle of rotation.

9. A liquid dispensing device as defined in claim 7 wherein said outlet opening means are a plurality of holes which are equally spaced around the entire circle of rotation.

10. A liquid dispensing device as defined in claim 1 wherein said outlet means is positioned within a surface of said body means adjacent to said rotor recess, the inner surface of said body means containing said outlet means is raised inwardly within said rotor recess and has a generally flat surface which is positioned adjacent to the rotating flat surface of said rotor means, the outlet means having an opening in said body surface whereby the liquid will be dispensed through said outlet opening from said rotor flat surface opening with a minimum of leakage while said rotor means is rotating.

11. A liquid dispensing device as defined in claim 1 wherein said nozzle channel means includes at least one nozzle means, said nozzle means being arranged so that the liquid passing through said nozzle means will impinge directly on the outer perimeter of said rotor tier at a sufficient angle to cause said rotor means to rotate.

12. A liquid dispensing device as defined in claim 11 wherein said nozzle means further includes means whereby the nozzle means can be variably positioned to control the angle that the liquid impinges on the outer perimeter of said rotor means whereby the force imparted to said rotor means can be varied in order to control the speed of rotation of said rotor means.

13. A liquid dispensing device as defined in claim 12 wherein all of the nozzle means connected to the same chamber distribution means are connected to a control means whereby all of the nozzles can be variably positioned at the same angle with respect to the outer perimeter of said rotor means.

14. A liquid dispensing device as defined in claim 13 wherein the control means is connected to all of the nozzle means for all of the chamber distribution means whereby all of the nozzles within the device can be variably positioned simultaneously to control the speed of said rotor means.

15. A liquid dispensing device as defined in claim 14 wherein all of the nozzle means connected to said control means are arranged so as to have the same angle with respect to the outer perimeter of said rotor means.

16. A liquid dispensing device as defined in claim 15 wherein the control means is a continuous ring positioned around the inside perimeter of said body means with each nozzle having a connecting means attached to said ring and said ring includes a means extending through said body means whereby the ring can be positioned from outside of said body means.

17. A pulsating shower dispenser for use with a plurality of liquids having distinct temperature differences, the shower dispenser comprising:

(a) a body means having a liquid inlet means and a liquid outlet means, said body means also including a rotor recess positioned within said housing means;

(b) said liquid inlet means including separate liquid conduit means having connector means for each separate liquid to be dispensed, said connector means being connected to a suitable pressurized source of said liquid;

(c) distribution means arranged within said body means, said distribution means including a distribution chamber and one or more channels for each separate liquid to be dispensed, each distribution chamber being connected to one of said inlet conduit means, each channel being connected at one end to said distribution chamber with the other end connected to a nozzle means which is positioned adjacent to the outer perimeter of said rotor recess;

(d) a cylindrical rotor means arranged to freely rotate within the rotor recess formed within said body means, said rotor means being divided into a plurality of tiers along the axis of rotation, a separate tier being provided for each liquid to be dispensed, one end of said cylindrical rotor means being a flat surface of rotation and each rotor tier having one or more open segments which extend from the perimeter of the rotor tier to an opening in the surface of rotation of said rotor means, all of the surface openings on said rotor means being positioned at approximately the same radial distance from the axis of rotation of said rotor means, said nozzle means being positioned to direct the liquid flow from each channel at an angle to the perimeter of said rotor means whereby the force of the liquid impinging upon the open segments in the rotor tiers will cause the rotor to rotate at a desired rotational speed; and (e) said outlet means have a plurality of openings in the surface of the body means, said outlet dimension and coincide with the openings in the surface of rotation of said rotor means whereby individual pulsed streams of liquid having different temperatures will be dispensed alternately from said outlet means as said rotor means rotates within said housing means.

18. A pulsating shower dispenser as defined in claim 17 wherein said nozzle means are arranged to pivot whereby the liquid issuing from the nozzles can be angularly varied with respect to the perimeter of the rotor means so that the rotational force applied to the rotor means and thus the rotational speed of the rotor means can be varied.

19. A pulsating shower dispenser as defined in claim 18 wherein an equal number of channels are connected to each distribution chamber and the individual channels are alternately positioned with respect to the channels connected to the other distribution chambers around the outer circumference of the rotor recess within said housing means.

20. A pulsating shower dispenser as defined in claim 19 wherein each of the nozzle means connected to the same distribution chamber are connected together by suitable means whereby all nozzle means carrying the same liquid can be variably positioned simultaneously.

21. A pulsating shower dispenser as defined in claim 20 wherein all of the nozzle means within the shower dispenser are connected to a single control means which includes a means movable from the outside of said body means whereby all nozzle means within the dispenser can be angularly moved at the same time to precisely control the speed of rotation of the rotor means.

22. A pulsating shower dispenser as defined in claim 21 wherein the movable means is a lever means arranged to extend through an opening in the body means whereby said control means can be properly positioned.

23. A pulsating shower dispenser as defined in claim 17 wherein the body means includes a separate cover means which includes the outlet means.

* * * * *